United States Patent [19]

Kormendy

[11] 4,234,163

[45] Nov. 18, 1980

[54] ENGAGEMENT DEVICES

[75] Inventor: Miltiades Kormendy, Rolleston-on-Dove, England

[73] Assignee: Coal Industry (Patents) Limited, London, England

[21] Appl. No.: 883,105

[22] Filed: Mar. 3, 1978

[30] Foreign Application Priority Data

Mar. 15, 1977 [GB] United Kingdom ..... 10836/77

[51] Int. Cl.[3] ..... B66F 1/04

[52] U.S. Cl. ..... 254/108

[58] Field of Search ..... 254/105, 108–110, 254/93 R; 104/162; 105/31; 269/208

[56] References Cited

U.S. PATENT DOCUMENTS

| | | | |
|---|---|---|---|
| 3,435,621 | 4/1969 | Johnson | 254/106 |
| 3,449,910 | 6/1969 | Reynolds | 254/93 R |
| 3,635,440 | 1/1972 | Van Gompel | 254/93 R |
| 3,821,934 | 7/1974 | Maeda | 254/105 |
| 3,832,945 | 9/1974 | Muto et al. | 104/162 |
| 3,870,279 | 3/1975 | Century | 254/105 |

FOREIGN PATENT DOCUMENTS

| | | | |
|---|---|---|---|
| 901008 | 7/1962 | United Kingdom | 254/105 |

*Primary Examiner*—Robert C. Watson

*Attorney, Agent, or Firm*—James Creighton Wray

[57] ABSTRACT

The device is attached to one end of a driving ram located on a mining machine, and comprises a locking ram operable independently of the driving ram. The locking ram is used to force an abutment into locking engagement with an abutment portion in the track on which the machine runs. The device may also include a stop and a guide to ensure that the abutment and abutment portion remain engaged until the locking ram is used to force them out of engagement.

22 Claims, 3 Drawing Figures

ENGAGEMENT DEVICES

Figure 1:
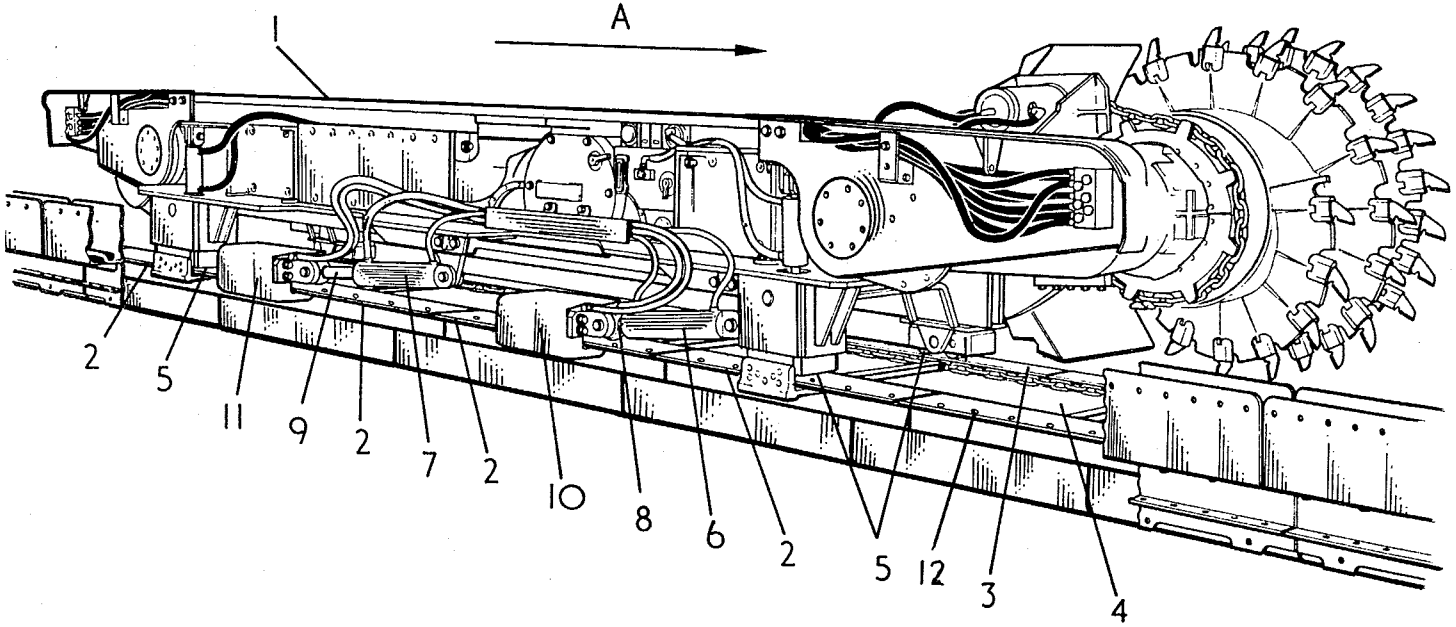

This invention relates to engagement devices and in particular to engagement devices to be used in the movement of mining machines along a track.

In mineral mining operations, especially in coal mining operations, a large amount of mineral is won using a system known as longwall mining. In this system a mining machine is mounted on a track and is traversed to and fro across the face of the seam which is being mined. As the machine traverses the face and wins minerals therefrom the track, usually a conveyor or an attachment thereto, on which the machine is moving is advanced towards the face, usually in a manner known as "snaking".

The track, on the conveyor, which guides the machine is associated with a series of roof supports through complementary advancing rams. Once the machine has cut a section of the face and passed on, the track behind the machine is advanced towards the face by extending the advancing rams. As soon as the track has been advanced the roof supports are advanced towards the track by retracting the advancing rams. This operation is known as "snaking". Thus, once the machine has completed a traverse the track has been advanced so that when the machine traverses in the opposite direction it is in a position adjacent the newly formed face ready to win coal.

The machine is traversed across the face either by a haulage chain or by chainless haulage. In the first case a chain is stretched along the face, the chain passing through the machine over a winch which drags the machine to and fro across the face along the chain. Alternatively, the winch is located at one of the face ends and the machine is attached to the chain, which is continuous, thus enabling the machine to traverse in either direction. This type of haulage has many disadvantages. For instance the movement of the machine is not usually very smooth, due to such factors as the elasticity of the chain, the varying hardness of the material in the seam, and the varying frictional force between the machine and the track. There is also a danger that the chain will break during operation, which is very hazardous for operatives in the vicinity of the machine. In this type of haulage the track, e.g. the conveyor only serves to ensure that the machine follows a path adjacent the face.

To avoid the problem associated with the haulage chain, various types of chainless haulage have been developed. Two main types of chainless haulage are used, both of which involve the use of a track, which is normally mounted on, or at least associated with a face conveyor, which removes mined mineral matter from the face area. In the first type the track is constituted by a rack and the machine is provided with a driven pinion arrangement to form a rack and pinion type drive.

The second type of chainless haulage is ram propulsion haulage. The machine is attached either to the body or to the piston rod of two or more double-acting fluid operable driving rams, generally hydraulic rams. The other ends of the rams are attached to engagement devices which are located around and engageable with the track. When a driving ram is actuated to extend the piston rod from the body it also acts to engage the engagement device with the track. With the device engaged with the track, the extension of the piston rod acts to move the machine along the track. The ram is then actuated to retract the piston rod. This also releases the engagement device from engagement with the track, and so that device is moved along the track. In normal operation there are a pair of driving rams which are operated out of phase so that while one driving ram is extending the other driving ram is retracting. The retraction step may be carried out more quickly than the extension step and so it is possible to achieve smooth movement of the machine across the face by having the extension steps partly overlapping. Thus in the ram-driven type of chainless haulage as described above, the driving rams perform two functions, in that they cause the engagement of the engagement device with the track and they move the machine along the track.

However, it has been found that the force exerted by the driving rams is greatly in excess of the forces needed to effect engagement of the engagement device and to move the machine separately. Therefore the driving rams do not act efficiently, and draw more power than is necessary from the hydraulic or pneumatic power system.

In our co-pending British Pat. No. 1,558,987 we disclose one device which utilises the driving rams more efficiently, but which may have slight drawbacks in some instances.

It is an object of the present invention to provide an alternative ram-driven chainless haulage system which utilises the driving rams more efficiently, and uses positive mechanical rather than frictional engagement with a track, and which therefore is able to use less power.

According to the present invention there is provided an engagement device to be used in a ram-driven chainless haulage system including a driving ram and spaced apart abutment portions on a track, the device comprising a movably mounted abutment and a double acting locking ram, operable independently of the driving ram, which locking ram is operable to move the abutment into and out of engagement with consecutive abutment portions of the track.

The abutment portions may comprise pegs fixed into or onto the track and the abutment may define a hole into which the peg may be fitted. Preferably however the abutment portions are holes in the track and the abutment is a peg.

The driving and locking rams may be independently either pneumatically or hydraulically powered.

The or each locking ram is located on the engagement device and is conveniently located such that the piston rod extends and retracts in a direction parallel or substantially parallel to the track of the haulage system.

The or each locking ram may also be located perpendicular or at any desired angle to the track, and may be connected to the abutment by a suitable lever system. The disposition of the locking ram is selected according to the practical requirements of the machine with which the engagement device is to be associated and the application of the machine. For example, in thin seams the horizontal arrangement is to be preferred to a vertical disposition in view of the height restrictions.

Preferably the abutment portions in the track are evenly spaced apart and are of the same cross-sectional shape as, but marginally of greater cross-sectional area than, the abutment. The abutment may be of any desired shape and may be tapered at its end remote from the locking ram. Preferably the abutment and abutment portions are of square cross-section, so that the abutment cannot rotate to any substantial degree when engaged with an abutment portion in the track.

Conveniently there is provided a locking means which acts such that the abutment cannot be disengaged from an abutment portion in the track except by action of the locking ram. The locking means will be necessary if the engagement device includes two or more pivot points. The locking means may comprise further locking rams, but preferably the engagement device is provided with a guide which constrains the abutment to move along a straight line, into and out of engagement with an abutment portion, the length of the line being determined in relation to the stroke of the locking ram. A stop may also be provided to ensure that the locking ram does not over-extend and cause the abutment to become disengaged from an abutment portion in the track when the abutment should be so engaged.

In the case wherein the abutment is a peg, a plate located on the side of the track remote from the locking ram may be provided to act as a limiting means to prevent the peg from protruding too far through any of the holes in the track.

The engagement device may be provided with wheels, rollers, bearing surfaces, or any combination thereof, to enable the device to move easily along the track when not in engagement therewith.

Figure 2:
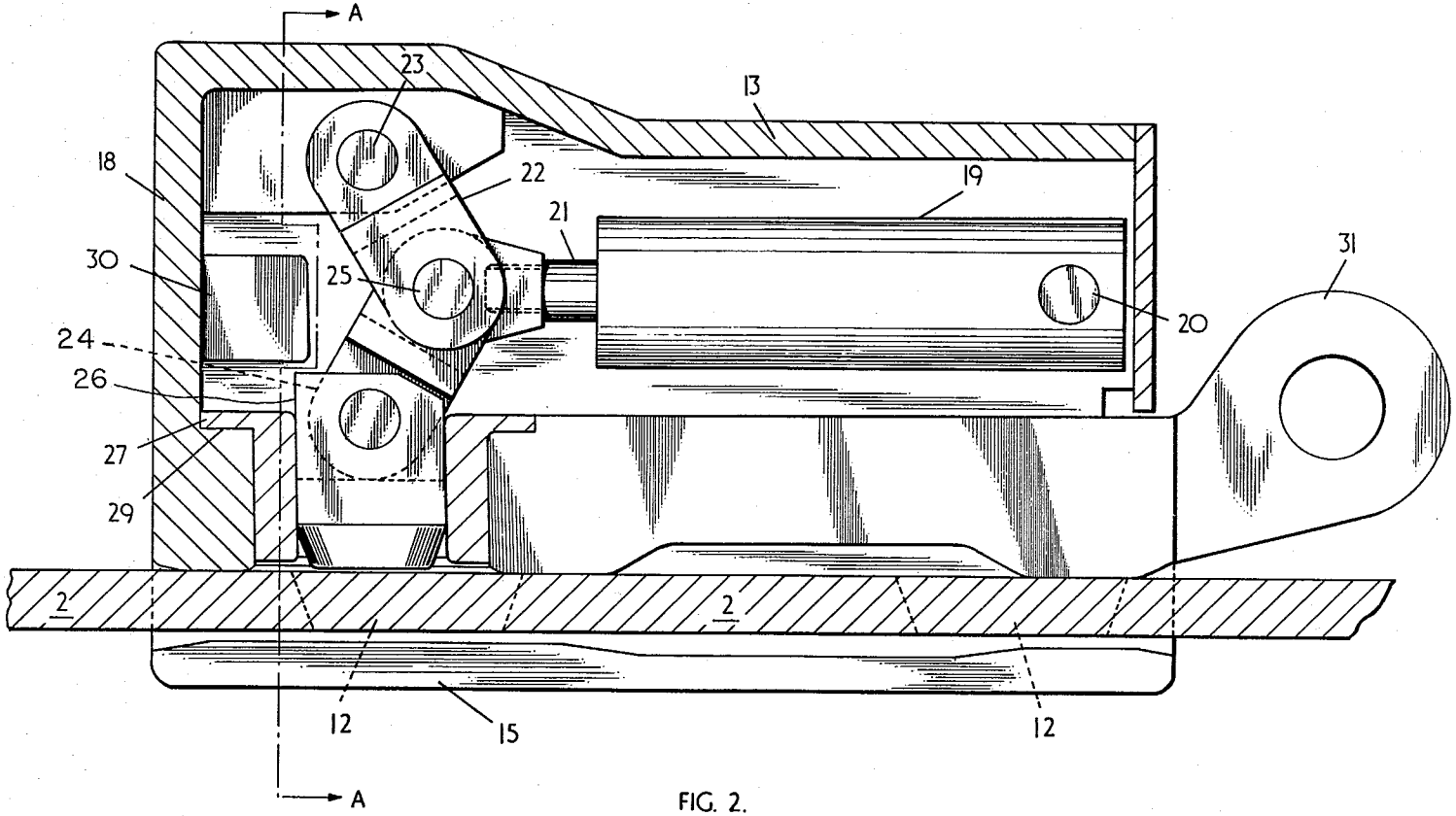
Figure 3:
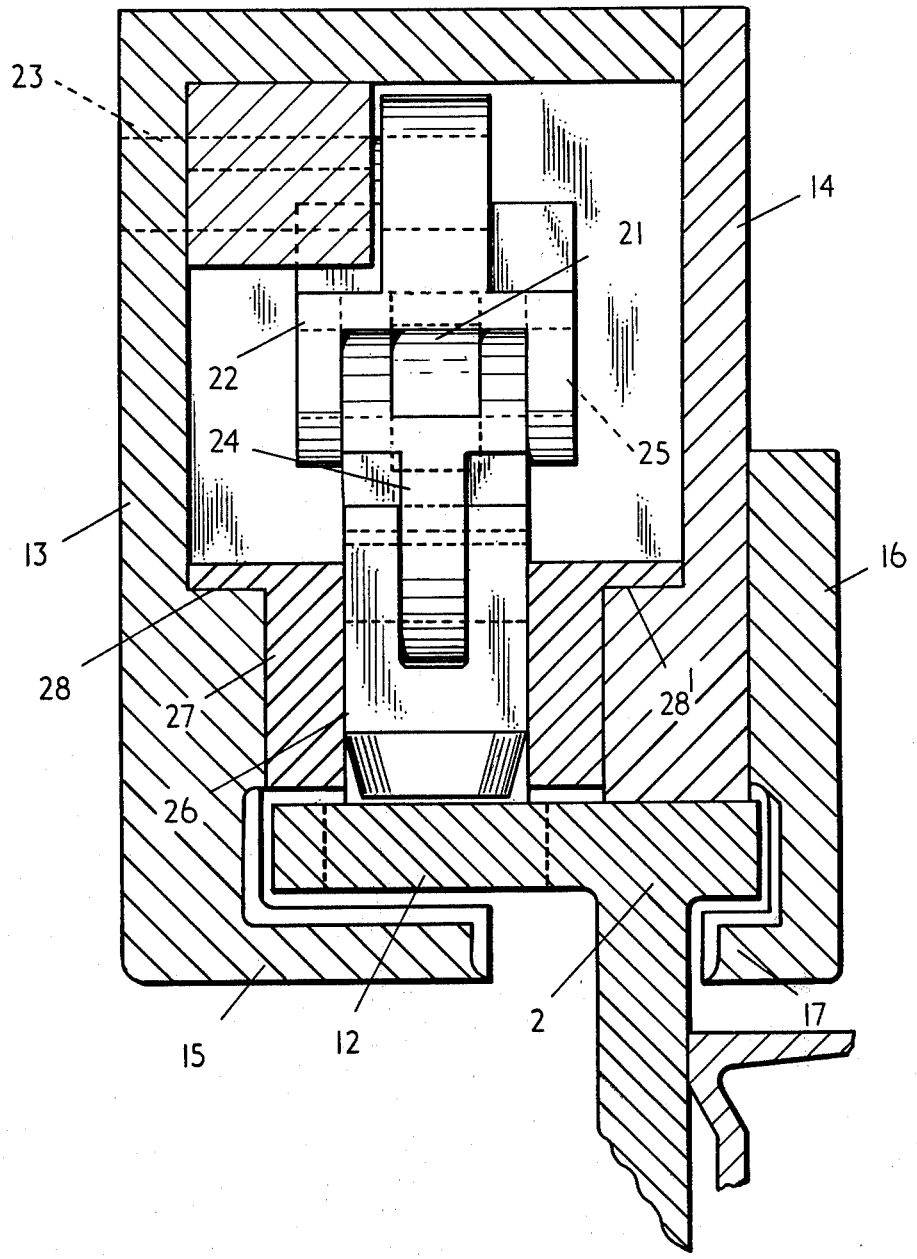

By way of example only one embodiment of an engagement device according to the present invention will now be described with reference to the accompanying drawings, in which;

FIG. 1 shows a perspective view of a ram-driven coal-mining machine including two identical engagement devices according to the invention, FIG. 2 shows a sectional side elevation of the engagement device and FIG. 3 shows a sectional end elevation along line A—A of the engagement device of FIG. 2, Referring to FIG. 1, a mining machine 1, in this case a ranging-drum shearer, runs along a track 2 and an upper flange 3 on face conveyor 4. The track 2 comprises a series of horizontal steel plates which are fixed to the face conveyor 4, which, in use, is positioned parallel and adjacent to a coal face (not shown). A linear series of square holes 12 spaced 10 inches apart are provided in the track 2. The machine 1 is mounted on rollers 5 which run along the top of the track 2 and on the upper flange 3. The cylinders of two hydraulic double-acting rams 6, 7 are pivotally attached to the machine 1 and the piston rods 8, 9 are pivotally attached to two engagement devices shown diagrammatically at 10 and 11, respectively.

In FIGS. 2 and 3, to which reference is now made, no hydraulic connections are shown as these are well known in the art and need no further explanation. The engagement devices 10, 11 according to the invention are identical and each comprise two parallel spaced apart metal plates 13, 14, one being somewhat deeper that the other. The plates are joined across one end by a face plate 18. The tops of the plates 13, 14 are aligned and therefore the plate 13 extends below the plate 14 and carries a base plate 15, extending transversely thereof partly across the space between the plates 13, 14. An L-shaped plate 16 is attached to the plate 14 and extends downwardly therefrom to form an inwardly facing lip 17 below the plate 14.

A double acting hydraulic locking ram 19 is pivotally mounted centrally between the plates 13, 14 on a first bearing 20. The piston rod 21 of the locking ram 19 is pivotally attached to link means which are a locking member 22 and an arm 24 by pin 25. The locking member 22 is pivotally mounted between the plates 13, 14 on a second bearing 23. A square section peg 26 is pivotally attached to the end of the arm 24 remote from pin 25. The peg 26 is located in a square section guide 27 which is fixed between the plates 13, 14 on shoulders 28, 28' and 29 on the plates 13, 14 and face plate 18 respectively. A stop 30 is fixed between the plates 13, 14 to prevent the locking ram 19 over-extending. Lugs 31 are provided on the plates 13, 14 to be pivotally attached to the piston rod 8 or 9 of one of the driving rams 6 or 7 respectively.

In use the engagement device is located on the track 2 so that the peg 26 is located above a hole 12 in the track 2 and the base plate 15 and lip 17 are located below the track 2, to trap the track 2 within the engagement device 10 or 11.

As shown in FIGS. 2 and 3 the device is not engaged with the track 2. To engage the device with the track 2 the piston rod 21 of the locking ram 19 is extended from the cylinder until the piston rod 21 abuts the stop 30. The extension of the ram 19 causes the locking member 22 to pivot about bearing 23, causing the head of the piston rod 21 to move downwardly as well as away from the cylinder of the ram 19. Therefore, as the piston rod 21 extends, the arm 24 pivots about both pin 25 and its attachment to the peg 26. The movement of the arm 24 causes the peg 26 to move downwardly (as shown in FIGS. 2 and 3) through the guide 27 into the hole 12 in the track 2 and into abutment with the base plate 15. Disengagement of the device is achieved by activating the locking ram 19 to retract the piston rod 21, causing the locking member 22, the arm 24 and the peg to move in the opposite directions to the respective directions previously stated and therefore causing the peg 26 to disengage from the hole 12 in the track 2.

In order to move the machine 1 in the direction of arrow A in FIG. 1 the following cycle of operations is repeated as many times as is necessary to complete a traverse of the face. As shown in FIG. 1 neither of the engagement devices 10, 11 are engaged. Locking ram 19 of engagement device 10 is then extended to bring the engagement device 10 into engagement with a hole 12 in the track 2. Piston rod 8 of driving ram 6 is extended, and, because the engagement device 10 is engaged, the machine 1 is moved in the direction of arrow A. During the extension of piston rod 8 of driving ram 6, the piston rod 9 of driving ram 7 is being retracted, and since the engagement device 11 is not engaged, the engagement device 11 moves along the track 2. As soon as the piston rod 9 is fully retracted and the piston rod 8 is fully extended, the locking ram 19 of engagement device 11 is extended to bring the engagement device 11 into engagement with a second hole 12 in the track 2. The driving ram 7 is then actuated to extend its piston rod 9 and thereby move the machine 1. As soon as the piston rod 8 of driving ram 6 is fully extended the locking ram 19 of engagement device 10 is actuated to free the engagement device 10 from engagement with the track 2 and the piston rod 8 of driving ram 6 is retracted, thereby moving the engagement device 10 along the track 2. When the piston rod 8 is fully retracted the cycle is begun again. To ensure smooth operation of the cycle the spacing of the holes 12 in the track 2 should be related to the stroke of each of the driving rams 6 or 7.

In order to move the machine 1 in the opposite direction a similar cycle of operations is employed except that engagement devices 10, 11 are in engagement with holes 12 in the track 2 while their respective driving rams 6, 7 are in the retraction step.

Although the action of the engagement device 10, 11 is totally independent of the driving action of the driving rams 8, 9, it is often desirable to provide an interlocking control for both sets of rams, such that no driving action is initiated until the appropriate engagement device is engaged, and that no action which moves the engagement device is initiated until that engagement device is out of engagement with the track.

The control system may also be designed to effect the extension of the locking ram 19 of the unengaged engagement device before the extension or retraction of the driving ram associated with the engaged device is complete. This would enable the driving cycles of the driving rams to be overlapping and would enable the machine to be moved smoothly across the face. The action of the engagement device is totally independent of the extension or retraction of the driving rams 6, 7. Thus more efficient operation of the system may be achieved, since the driving rams 6, 7 are only used for driving and the locking ram 19 is only used for locking the engagement device into engagement with the track.

I claim:

1. An engagement device to be used in a ram-driven chainless haulage system including a driving ram and spaced apart abutment portions on a track, the device comprising a movably mounted abutment and a pivotally mounted double acting locking ram, operable to move the abutment into and out of engagement with consecutive abutment portions of the track, and a plate located on the side of the track remote from the locking ram to act as a limiting means to prevent the abutment from protruding too far through any of abutment portions in the track.

2. A device according to claim 1, wherein the abutment portions are holes in the track and the abutment is a peg.

3. A device according to claim 1, wherein the locking ram is located on the device such that a piston rod of the ram extends and retracts substantially parallel to the track of the haulage system.

4. A device according to claim 1, wherein the abutment is tapered at its end remote from the locking ram.

5. A device according to claim 1, wherein the abutment and abutment portions are of square cross section.

6. A device according to claim 1, and including locking means which act such that the abutment cannot be disengaged from an abutment portion in the track except by action of the locking ram.

7. A device according to claim 6, wherein the locking means comprises a guide which constrains the abutment to move along a straight line into and out of engagement with an abutment portion.

8. A device according to claim 1, and including a stop to ensure that the locking ram does not over-extend.

9. A device according to claim 1 in which the driving ram and the double acting locking hydraulic driving ram have independent hydraulic systems.

10. An engagement device for use in a ram-driven vehicle haulage system, the vehicle traversing along a preselected path providing spaced apart abutment portions for engagement by the device which, in use, is connected to a driving ram provided on the vehicle, the device comprising a body, an abutment slidably mounted in said body for movement between two operational modes drivably engaging and disengaging the abutment portions, respectively, a double acting ram, and link means pivotally connected to the abutment and to said double acting ram which, thereby, selectively is operable via the link means to urge the abutment to move between its two operational modes, the link means comprising a first link connection pivotally connected to the abutment and to said double acting ram by first and second pivotal mountings, respectively, and a second link connection connected to said second pivotal mounting and to the body.

11. A device as claimed in claim 10 in which a longitudinal axis of said double acting ram is transverse to the direction of movement of the abutment between its two operational modes.

12. A device as claimed in claim 10 in which said second pivotal mounting is on one end of said double acting ram and the other end of said double acting ram is pivotally connected to the body.

13. A device as claimed in claim 12 in which the body defines a slidway for the abutment.

14. A device as claimed in claim 13 in which a stop is provided to limit extention of said double acting ram.

15. An engagement device for use in a ram-driven chainless haulage system, which device is adapted to be engaged with spaced apart abutment portions on a track and to be connected to a driving ram, the device comprising an abutment adapted to be moved rectilinearly, a pivotally mounted, double acting locking ram having its direction of action substantially perpendicular to the direction of movement of the abutment, and a link means connecting the locking ram to the abutment, whereby the locking ram is operable to move the abutment into and out of engagement with an abutment portion of the track.

16. A device according to claim 15, wherein the abutment portions are holes in the track and the abutment is a peg.

17. A device according to claim 15, wherein the abutment is tapered at the end thereof which engages an abutment portion.

18. A device according to claim 15, wherein the abutment and abutment portions are of square cross-section.

19. A device according to claim 15, and including locking means which act such that the abutment portion cannot be disengaged from an abutment portion of the track except by action of the locking ram.

20. A device according to claim 15, and including a stop to ensure that the locking ram does not over extend.

21. A device according to claim 16, and including a plate to be located on the side of the track remote from the locking ram to act as a limiting means to prevent the peg from protruding too far through any of the holes in the track.

22. An engagement device to be used in a ram driven chainless haulage system including a driving ram and spaced apart holes in a track, the device comprising a movably mounted peg, a pivotally mounted double acting locking ram operable to move the peg into and out of engagement with consecutive holes in the track, and a plate located on the side of the track remote from the locking ram to act as a limiting means to prevent the peg from protruding too far through any of the holes in the track.

* * * * *